United States Patent [19]

Bullock

[11] Patent Number: 4,593,830

[45] Date of Patent: Jun. 10, 1986

[54] TAMPER-RESISTANT CONTAINER CLOSURE HAVING AUXILIARY REMOVAL FEATURES

[75] Inventor: Joseph J. Bullock, Atherton, Calif.

[73] Assignee: Bankers Trust Company, New York, N.Y.

[21] Appl. No.: 697,007

[22] Filed: Jan. 31, 1985

Related U.S. Application Data

[63] Continuation-in-part of Ser. No. 652,525, Sep. 20, 1984, which is a continuation-in-part of Ser. No. 517,666, Jul. 27, 1983, Pat. No. 4,484,687.

[51] Int. Cl.[4] ..... B65D 41/48

[52] U.S. Cl. ..... 215/256

[58] Field of Search ..... 215/256

[56] References Cited

U.S. PATENT DOCUMENTS

| | | | |
|---|---|---|---|
| 4,166,552 | 9/1979 | Faulstich | 215/256 |
| 4,303,167 | 12/1981 | Martinez | 215/256 |
| 4,385,708 | 5/1983 | Curry | 215/256 |
| 4,484,687 | 11/1984 | Bullock | 215/256 |

FOREIGN PATENT DOCUMENTS

| | | | |
|---|---|---|---|
| 1393366 | 2/1965 | France | 215/256 |

*Primary Examiner*—Donald F. Norton

*Attorney, Agent, or Firm*—Julian Caplan

[57] ABSTRACT

To prevent tampering with the contents of containers, the neck of the container is formed with external beads with grooves under the lower surfaces of the beads. The cap has an outer skirt formed with internal beads which lock under the shoulders of the neck beads. Preferably, the cap has an inner skirt which seals against the inside of the container neck. To remove the cap, a score-line is formed extending upward from the bottom edge of the skirt and merging with a horizontal scoreline located between the two internal beads, so that one may grip a tab on the lower edge of the skirt, pull upward on the substantially vertically section and thence horizontally around the horizontal scoreline. Unless the skirt is thus torn, it cannot be removed from the neck and tearing of the skirt indicates tampering with the contents of the container. In the present invention, instead of the horizontal scoreline continuing around the periphery of the cap, it terminates at an unscored area which connects the upper and lower portions of the skirt. The lower portion of the skirt may be gripped by the user as an auxiliary means of removing the cap. The primary means of removing the cap is a flange which extends outward from the top of the cap skirt and may be gripped by the finger and/or thumb to pull the cap off the neck.

10 Claims, 6 Drawing Figures

TAMPER-RESISTANT CONTAINER CLOSURE HAVING AUXILIARY REMOVAL FEATURES

BACKGROUND OF THE INVENTION

This application is a continuation-in-part of Ser. No. 652,525, filed Sept. 20, 1984, which was, in turn, a continuation in part of application Ser. No. 517,666, filed July 27, 1983, now U.S. Pat. 4,484,687.

1. Field of the Invention

The present invention relates to plastic caps which snap onto the necks of thin-walled plastic containers characterized by the fact that they are tamper-resistant. In order to withdraw the cap from the neck, it is necessary for the consumer to tear a portion of the skirt off the cap. The remainder of the cap comprises a reclosure cap which may be used repeatedly until the contents of the container are dispensed. The present invention differs, among other ways, from prior caps in that, when the skirt is torn, it is not necessarily totally removed from the reclosure cap but is connected thereto by a narrow, unscored area. Thus, the lower part of the skirt may be used as an auxiliary means for removing the reclosure cap, particularly useful for persons having arthritis and other handicaps which makes using the primary reclosure cap removal means difficult. The container neck is of a structure which is complementary to the cap, so that the combination of cap and container neck is liquid tight and tamper-resistant.

2. Description of the Prior Art

Cap and neck constructions of this general type are shown in U.S. Pat. No. 3,338,446 and, more recently, in U.S. Pat. No. 4,202,455. Complementary beads on the interior of the outer skirt of the cap snap into grooves on the container neck. A circumferential score-line is located in the outer skirt intermediate the beads and a second score-line extends from the circumferential score-line to the bottom edge of the skirt. A tear tab on the bottom of the skirt may be gripped and torn upward, causing the cap to tear on the second scoreline. A feature of the present invention is the fact that the second score-line is not circumferential, but a portion thereof between 10° and 180° is of the same thickness as the remainder of the outer skirt. The unscored area connects the reclosure cap above the otherwise circumferential scoreline to the lower portion of the skirt. By grasping the lower portion of the skirt and pulling upwardly, the reclosure cap may be removed from the neck as secondary means of removal. Primary means of removal of the cap comprise a peripheral flange extending out from the top edge of the cap. The present invention is intended for narrow neck plastic containers which are nominally of 35 mm in diameter. Plastic caps for 5-gallon bottles have heretofore had interrupted score-lines. Examples of these prior caps are illustrated in U.S. Pat. Nos. 3,392,860; 3,392,862; 3,840,137 and 3,979,002.

In all of the last-mentioned prior patents, the provision of a reclosure cap has been of secondary importance. Primary reasons for the interruption of score-line have been, first of all, to direct the hand of the service man removing the plastic cap prior to installation of the neck of the bottle in a water dispensing cooler away from the neck so as to prevent contamination of the neck and, secondarily, to provide a torn cap which can be placed over the neck of an empty container to protect the neck of the container against damage when bottles are racked in a truck for return to the bottle filling facility.

Small mouthed plastic containers for milk and water are not normally installed in dispensing machines. Hence, each time the patron wishes to dispense a quantity of milk or water, the reclosure cap is removed and, after dispensing, is replaced until the container is empty. As hereinafter explained, a primary means of removing the cap is a flange which projects from the upper end of the outer skirt. It is important that such a flange not be so constructed as facilitate dishonest patrons from using the flange to pry off the cap from the neck without removing the skirt. The very limitations on the size and shape of the flange which are desirable to prevent usage of the flange by dishonest patrons in overcoming the tamper-resistant features of the cap make it difficult for persons having arthritis and other infirmities to remove the reclosure cap. The present invention provides an auxiliary means particularly useful for handicapped patrons.

OBJECTS OF THE INVENTION

A primary object of the present invention is to provide a cap having a skirt scored so that a substantial portion thereof may be torn off but having an unscored area which deters complete separation of the lower portion of the skirt from the upper portion. Thus, after the skirt has been torn to the full extent of the perforations thereof, the lower portion of the skirt remains attached to the reclosure cap and may be grasped by the user and used to pull the reclosure cap off the neck. The primary means of removal of the reclosure cap comprises a flange extending out from the upper edge of the skirt which may be pried upward by the thumbs and/or fingers of the patron to pull the reclosure cap off the neck. Such a flange is intended for use only after the skirt has been torn to free the lower bead on the interior of the skirt from locking engagement with the mating groove in the container neck. Experience has shown, however, that dishonest patrons sometimes use the flange to pry the cap off the neck without tearing the skirt. Hence, the flanges must be constructed so that they do not provide a dishonest patron with sufficient purchase to pry the cap off. This same limitation, however, makes it difficult for handicapped patrons to use the flange, even after the skirt has been torn. Thus, it is a principal object of the present invention to provide as a primary means of removal of the reclosure cap a flange of one of the types hereinafter described and also to provide a secondary means, namely the attached lower portion of the skirt, which may be gripped by handicapped persons to pull off the cap. The arcuate extent of the unscored area connecting the upper portion of the skirt to the lower portion varies between 10° and 180°. This area is determined by where the circumferential score-line terminates relative to its point of origin. An additional feature of the invention is the fact that the patron who does not need the auxiliary reclosure cap removal means may, either by using a knife, scissors or simply tearing the cap, pull off the lower portion of the skirt.

Various flanges have been used on reclosure caps to permit the user to pry off the reclosure cap; however, it is important that the flange not be capable of use to pry the entire cap off the neck prior to tearing off the cap skirt. One prior alternative has been to make the flange flexible as shown in U.S. Pat. No. 4,166,552. In accordance with the present invention, means are also provided to inhibit the fingernails from being used to pry the flange upward. In one form of the invention, the underside of the flange is slanted downwardly-inwardly, at an angle of about 45°. The slanted portion may terminate at the upper edge of the flange, or there may be a thin, relatively vertical surface at the extreme periphery of the flange.

SUMMARY OF THE INVENTION

The invention of the present application has been described in the foregoing objects of the invention and in the discussion of the prior art. The cap differs from prior caps in one important respect in that there are two means provided to remove the reclosure cap from the neck. The primary means used by persons not having infirmities which prevent its use is a flange on the exterior of the top of the cap pried upward by the fingers and/or thumb after the lower portion of the skirt has been torn away. A secondary means of removal is provided by terminating the upper scoreline of the cap skirt short of 360° so that an unscored area remains which connects the reclosure cap to the lower portion of the skirt. This lower portion may be gripped and used to pry the cap off the neck. Where the patron does not need this auxiliary means, he may cut or tear through the connecting skirt area to free the lower portion of the skirt from the reclosure cap.

Other objects of the present invention will become apparent upon reading the following specification and referring to the accompanying drawings in which similar characters of reference represent corresponding parts in each of several views.

In the drawings

BRIEF DESCRIPTION OF THE INVENTION

Figure 4:
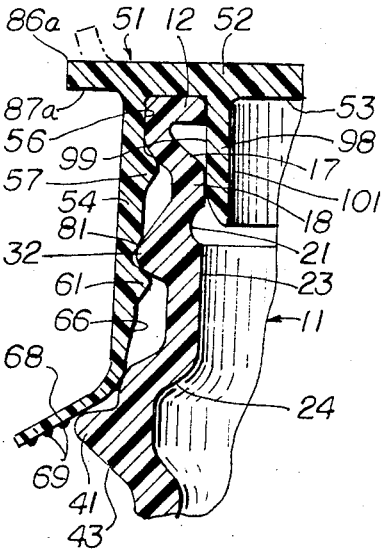
FIG. 4 is a view similar to FIG. 3 showing the cap seated on the neck.
Figure 3:
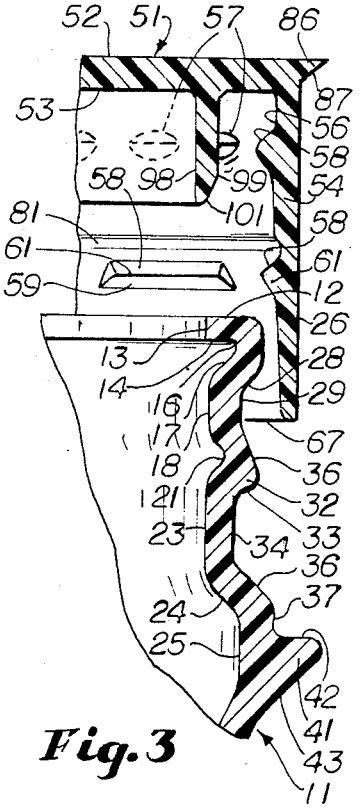
FIG. 3 is an exploded fragmentary enlarged sectional view showing portions of the cap and neck prior to assembly.

In FIGS. 3 and 4 is shown one form of container neck with which the present invention may be used. Neck 11 has a thin inward extending horizontal flange 12 which terminates in a substantially vertical inner edge 13. Below edge 13 of flange 12 is a substantially horizontally outwardly extending surface 14 which terminates in a top internal groove 16. Below groove 16, the inside wall of the neck 11 slants downwardly-outwardly in a surface 17 terminating in a vertical wall 18. Below wall 18 is a second internal groove 21 and below the groove 21 is another vertical wall 23 which terminates in a outwardly-downwardly slanted wall 24 which, in turn, terminates in an internal vertical wall 25. The internal structure of the neck 11 is subject to considerable variation.

Figure 1:
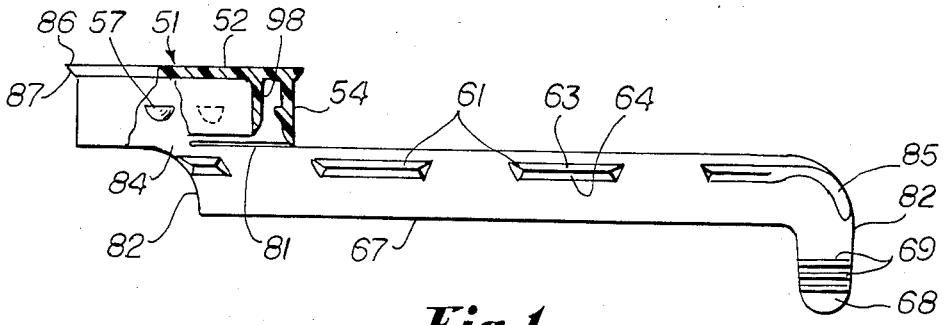
FIG. 1 is a side elevational view of a cap in accordance with the present invention, partly broken away in section and showing the lower portion of the skirt partially torn away.

Directing attention next to the exterior of the neck 11, the top corner 26 where flange 12 originates is slightly rounded and merges into top external vertical wall 27, There is a slightly inwardly directed shoulder 28 at the lower edge of wall 27 which continues inward and merges into groove 29 which is of lesser diameter than wall 27. Below groove 29 is a downwardly-outwardly slanted wall 31 which comprises the top surface of external locking bead 32. The lower edge of bead 32 comprises a shoulder 33. Below shoulder 33 is a second external vertical wall 34 which is of lesser diameter than groove 29. Below wall 34 is an outward slanted wall 36 which terminates in third external elongated vertical wall 37 which has a diameter greater than wall 27. At the bottom of surface 37 in a preferred embodiment of the invention, is a shoulder 41 having a top surface 42. Below shoulder 41, the neck 43 has an inward-downward slanted surface 43. Shoulder 41 may cooperate with various grippers (not shown) used in filling, capping and loading equipment. The shoulder 41 also prevents the grippers from contacting the cap 51 and thus reduces the chance of the cap being pulled off the neck during loading, etc. It will be understood that the shape of both the interior and exterior of neck 11 are subject to considerable variation. Directing attention now to cap 51, the preferred embodiment illustrated herein is subject to considerable variation. In general, the configuration thereof resembles a highly commercially successful cap manufactured by the licensee of the assignee of this application. The cap 51 has a preferably flat top disc 52 on which a label or printed matter may be applied. The underside 53 of disc 52 is also preferably substantially flat. Depending from disc 52 is an outer cap skirt 50 having an external wall 54 which, in the preferred embodiment, is smooth and substantially vertical. The inside surface of skirt 50 has a top internal vertical wall 56. Top locking bead means 57 are provided on the interior of skirt 50 below the wall 56 positioned to lock under the shoulder 28 in the assembled condition of the cap and neck shown in FIG. 4. Upper bead means 57 may be continuous, but in the preferred embodiment shown best in FIGS. 1 and 3 is interrupted. The interrupted bead sections have substantially horizontal top surfaces 58 and downwardly slanted surfaces 59 which terminate slightly above upper horizontal score-line 81. Below score-line 81 are second or lower bead sections 61 which may be continuous but, as shown in the accompanying drawings are interrupted. The interrupted bead sections 61 are shown as longer than the upper sections 57, but this is not essential to the present invention. Bead sections 61 have substantially horizontal upper surfaces 58 which lock under the shoulders 33 and downwardly-outwardly slanted surfaces 59 therebelow. Below bead section 61 is a third vertical wall 66 which extends down to the bottom edge 67 of skirt 50. At one location along the bottom edge 67, there is a depending tear tab 68 which may have gripper ridges 69 on its interior surface The slanted surfaces 59 and 64 facilitate cap 51 sliding over corner 26 and surface 61 without splitting skirt 50.

In a preferred embodiment of the invention, an inner skirt 98 depending from disc 52 is provided, the outer wall 99 thereof sealing against the surfaces 13, 18 and 23 of the inner wall of the container neck 11. Preferably, the lower edge 101 of inner skirt 98 is tapered to facilitate capping.

Spaced between the lower bead section 61 and the upper bead sections 58 is an internal scoreline 81 which, in the present invention does not extend completely around the inside of the skirt 50, but has a connecting area 84 (see especially FIG. 1) which joins the portion 83 of the skirt below line 81 to the portion thereabove. The extent of the area 84 is subject to variation, but in preferred embodiments in a angular sense, this area may be between 10° and 180°.

Figure 2:
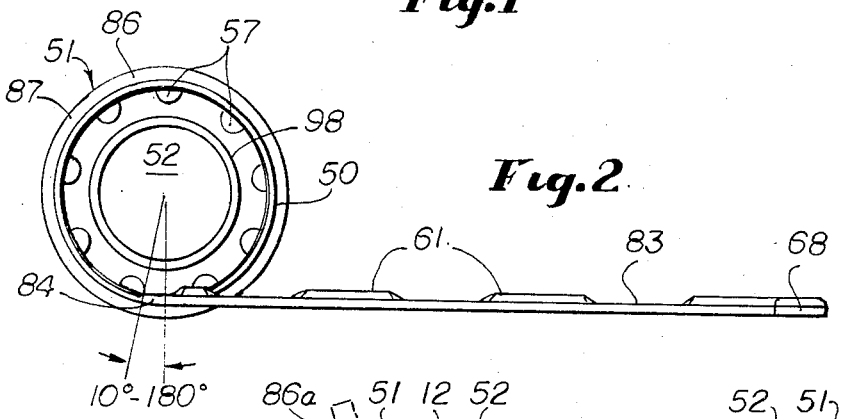
FIG. 2 is a bottom plan view of the structure of Fig. 1.

Extending upward from the bottom edge 67 of cap 51 in immediate proximity to the tear tab 68 is a curved or slanted score-line 82 which merges with the scoreline 81. Scoreline 82 curves upwardly and to the right from the left side of the tab 68. However, the line 82 might also curve upwardly and to the left of the right edge of the tab 68. A thickening 85 of the wall 54 adjacent line 82 prevents tearing off the tab 68, particularly if the user pulls the tab in the wrong direction. In order to remove cap 51 from neck 11, the user grasps the tab 68 and pulls upwardly along line 82 and thence along line 81 until the unscored area 84 is reached. If desired, the user may pull off the lower portion 83 of the skirt, in order to tear through the area or may cut this area with a knife, shears or other means. However, as later appears, the preferred form of the invention, best shown in FIGS. 1 and 2 comprises a secondary or auxiliary means of removing the cap 51 from the neck. Thus the user may grasp the portion 83 and pull upwardly, causing the skirt 54 to deform so that the beads 57 escape from under the shoulder 58.

Figure 6:
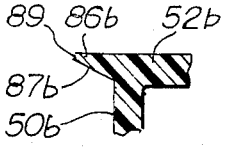
FIG. 6 is a fragmentary sectional view illustrating an alternate flange construction.

As shown in FIGS. 1 and 3, a peripheral flange 86 projects out from the disc 52 at the upper end of wall 54. The underside 87 of the flange 86 slants upwardly-outwardly from the exterior of skirt 54 at an angle of about 45°. Thus, it is difficult for one to pry the cap off the neck 11 with the skirt 50 intact. FIG. 6 shows a thin vertical edge 89 at the outer edge of the slanted surface 87*b*. As an alternate structure shown in FIG. 4, the flange 86*a* is rectangular in cross-section and there is a sharp corner 89 where the underside of the flange 86*a* intersects wall 54. If an attempt is made to pry upward on flange 86*a* while the skirt is intact, because of the corner 89, the flange tears. This prevents removing the cap and also indicates that an attempt has been made to tamper with the contents of the container.

Additionally, the flange 86*a* may be made very flexible, so that if an attempt is made to pull up on the flange, it bends, as shown in dot-and-dash lines in FIG. 4.

Figure 5:
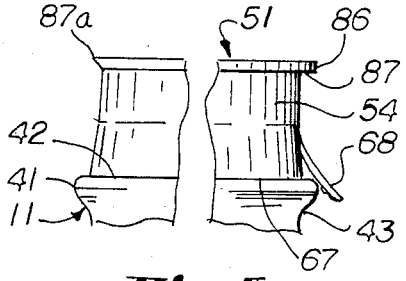
FIG. 5 is fragmentary elevational view showing the cap seated on the neck and broken away to show alternate flange constructions.

An additional tamper-resistant feature is shown in FIG. 5. Thus, the bottom edge 67 of the skirt 54 fits tightly against the shoulder 51. It is difficult or impossible for one to get one's fingernails under the edge 67 to pry the cap off while the skirt is intact. In the region where the tear tab 68 extends down below the lower edge 67 (see FIG. 4) the cap flexes sufficiently so that the tab 68 bends outwardly. It is thus relatively easy for the patron to grip the tear tab 68 where it projects outwardly.

In prior caps of this general type, where the scoreline 81 continued around the entire circumference of the cap, the lower portion 83 of the skirt 50 was completely torn off. Then the user pried upwardly on flange 86, 86*a* or 86*b*, to remove the upper portion of the cap which constitutes a reclosure cap. Although most patrons have no difficulty in using the flanges 86, 86*a* and 86*b* for such purpose, some patrons, because of arthritic conditions in the fingers, or other ailments, find it very difficult to remove the reclosure cap in this fashion. Making the flange larger, or making it easier to grip defeats the tamper-resistance of the cap in that the sronger and more easily gripped the flange may be, the easier it would be to pull the cap off the neck before the skirt is torn.

Accordingly, the present invention is distinguishable in that it not only has flanges 86, 86*a*, 86*b* and other modifications of the shape thereof as a primary means of pulling the reclosure cap off the neck, but also by having the unscored portion 84 located at the end of the score line 81 makes it possible for the user to grip the lower skirt portion 83 and use it as a means of pulling the reclosure cap off the neck. Where a patron does not need the cap removal features of the lower portion of the skirt, by pulling or by use of a knife or shears he may cut throu9h the area 84, leaving a reclosure cap similar to prior art reclosure caps.

What is claimed is:

1. A plastic cap for sealing a container neck having a top finish comprising a top disc having a depending skirt, said skirt having first bead means extending around the inside of said skirt spaced downward from said disc, second bead means extending around the inside of said skirt spaced downward from said first bead means, a first scoreline between said first and second bead means, said first score-line extending only partially around said skirt with an unscored area of between 10 and 180 degrees arcuate length at the end of said first score-line, a second scoreline extending up from the bottom edge of said skirt and merging with said first score-line, tear means on said bottom edge adjacent said second score-line, whereby by pulling said tear means the bottom of said skirt may be torn by tearing upward along said second score-line and then around said first score-line to the end of said first scoreline and thereby to release said second bead means from said top finish, the portion of said skirt below said first scoreline remaining attached to the upper portion of said skirt at said unscored area, said first and second bead means being engageable with third and fourth bead means, respectively, on the exterior of said neck to resist removal of said cap without tearing said skirt up to said unscored area, the portion of said skirt below said first scoreline comprising gripping means for pulling said cap off said neck by stretching said skirt to release said first bead means from said third bead means.

2. A cap according to claim 1 which further comprises a thin peripheral flange around the top of the exterior of said skirt, said flange comprising means to pry off said cap only when said skirt has been torn along said first score-line up to said unscored area.

3. A cap according to claim 2 in which the underside of said flange slants downward-inward to merge with the exterior of said skirt.

4. A cap according to claim 2 in which said underside of said flange terminates below the top of said flange to form a short, vertical edge for said flange.

5. A cap according to claim 2 in which the underside of said flange extends inward to form a sharp corner at the exterior of said skirt, whereby if one attempts to pry up on said flange said cap tears upward-inward from said corner to indicate tampering.

6. A cap according to claim 1 which further comprises a second skirt depending from said top disc inside said first-mentioned skirt.

7. A cap according to claim 1 in which at least one of said bead means is interrupted to form bead sections with gaps between said bead sections.

8. A cap according to claim 1 in which said first bead means is interrupted to form first bead sections with first gaps between said first bead sections and said second bead means is interrupted to form second bead sections with gaps between said second bead sections.

9. In combination, a plastic cap and a container neck, said cap comprising a top disc having a depending skirt, said skirt having first bead means extending around the inside of said skirt spaced downward from said disc, second bead means extending around the inside of said skirt spaced downward from said first bead means, a first score-line between said first and second bead means, said first scoreline extending only partially around said skirt with an unscored area of between 10 and 180 degrees arcuate length at the end of said first score-line, a second score-line extending up from the bottom edge of said skirt and merging with said first scoreline, tear means on said bottom edge adjacent said second scoreline, whereby by pulling said tear means the bottom of said skirt may be torn by tearing upward along said second scoreline and then around said first score-line to the end of said first score-line and thereby to release said second bead means from said neck, the portion of said skirt below said first score-line remaining attached to the upper portion of said skirt at said unscored area, said container neck comprising a top neck finish, external third and fourth bead means on the exterior of said neck in a position to engage said first and second bead means to resist removal of said cap without tearing said skirt up to said unscored area, the portion of said skirt below said first scoreline comprising gripping means for pulling said cap off said neck by stretching said skirt to release said first bead means from said third bead means.

10. A combination according to claim 9 which further comprises an external shoulder on said neck positioned to fit tightly under the lower edge of said skirt to impede attempts to pry the lower edge of said skirt upward, the width of said shoulder being approximately equal to the thickness of said skirt.

* * * * *